United States Patent [19]

Freyer

[11] Patent Number: 5,028,050

[45] Date of Patent: Jul. 2, 1991

[54] GOLFER'S GRIP TRAINING DEVICE

[75] Inventor: Hendrik Freyer, Laren, Netherlands

[73] Assignee: Golf Training B.V., Netherlands

[21] Appl. No.: 541,260

[22] Filed: Jun. 20, 1990

[30] Foreign Application Priority Data

Jun. 22, 1989 [NL] Netherlands ..... 8901585

[51] Int. Cl.[5] ..... A63B 69/36; A41D 19/00

[52] U.S. Cl. ..... 273/183 B; 2/161 A; 273/DIG. 30

[58] Field of Search ..... 273/DIG. 30, 166, 183 B, 273/183 R, 165; 2/161 A, 159, 161 R

[56] References Cited

U.S. PATENT DOCUMENTS

| | | | |
|---|---|---|---|
| 3,350,100 | 10/1967 | Carmines | 273/183 B |
| 3,508,280 | 4/1970 | Osborn | 273/166 X |
| 4,665,565 | 5/1987 | Odom | 273/DIG. 30 |

*Primary Examiner*—George J. Marlo
*Attorney, Agent, or Firm*—Lorusso & Loud

[57] ABSTRACT

A device for improving and training a right golf grip comprises a pair of gloves, wherein at least the back side of the thumb part and the back side of the index and middle finger parts together with their intermediate part of one glove, and at least a portion of the palm side of the little finger part and at least an area of the palm part of the other glove are provided with fastener means, preferably loop and hook tape, respectively. These fastener means cooperate with each other for interlocking the gloves in the right golf grip. In this device substantially the full palm side of the little finger part of the other glove is provided with fastener means and said area with fastener means of the palm part of this other glove extends with a large width substantially diagonally along said palm part from the insert side of the glove opposite of the little finger part. Moreover, at least said one glove is made of a material operating in the same manner as the corresponding fastener means so that the hands of the user are held one upon the other along the whole contact area, and produce a tearing sound when separated.

1 Claim, 2 Drawing Sheets

GOLFER'S GRIP TRAINING DEVICE

BACKGROUND OF THE INVENTION

The invention relates to a device for improving and training a right golf grip, comprising a pair of gloves, wherein at least the back side of the thumb part and the back side of the index and middle finger parts together with their intermediate part of one glove, and at least a portion of the palm side of the little finger part and at least an area of the palm part of the other glove are provided with fastener means, preferably loop and hook tape, respectively, which fastener means cooperate with each other for interlocking the gloves in the right golf grip.

One of the most important principles in golf is positioning one's hands on the grip of the golfclub. The mutual position of the left and right hands is of extreme importance. As a right golf grip and the right mutual position of one's hands is not as simple and natural as one sometimes thinks, it appears in practice that many golfers have a bad golf grip. Such a bad golf grip means a high interference for playing golf well, in particular with respect to making a right golf swing.

Improving and training the right golf grip is not simple and it is difficult to apply the instructions of the golf trainer, also for the starting golfer. Therefore, there is an urgent need for a device for improving and training a right golf grip.

U.S. Pat. No. 3,508,280 discloses a device of the abovementioned type, comprising a pair of gloves, of which one glove at the palm side at the end of the little finger and on a small area of the palm is provided with fastener means while the other glove at a part of the thumb and at the intermediate part between the index and middle fingers at the backside is provided with complementary fastener means In this manner the gloves can be interlocked in the right golf grip.

U.S. Pat. No. 4,664,565 discloses a device which is made in the same manner.

In this known devices an interlocking between the gloves is obtained along a relatively small area only, whereby the hands can still locally move away from each other and a movement of the hands during making the golf swing is possible without the golfer noticing the same.

SUMMARY OF THE INVENTION

It is an object of the invention to provide a device of the above-mentioned type wherein this disadvantage is eliminated in a simple and effective manner.

To this end the device of the above-mentioned type according to the invention is characterized in that substantially the full palm side of the little finger part of the other glove is provided with fastener means and in that said area with fastener means of the palm part of this other glove extends with a large width substantially diagonally along said palm part from the insert side of the glove opposite of the little finger part, wherein at least said one glove is made of a material operating in the same manner as the corresponding fastener means.

In this manner a device is obtained which holds the hands one upon the other in a mutual position for the right golf grip along an area as large as possible, so that the right golf grip can be improved and trained in practice, whereby the golfer builds the feeling of a right golf grip slowly but surely. Moreover, due to the material operating in the same manner as the corresponding fastener means it is obtained that each movement of the hands which results in a breaking of the contact between the gloves, is made audible for the user by the sound which is characteristic for breaking the connection between hook and loop tape. This indication function is of extreme importance during training the right golf grip as even very well trained golfers appear to move their hands in practice during the swing, which is a disadvantage for obtaining an impact in the right manner. Due to the indication obtained by using the device according to the invention, a very effective training is possible on maintaining the right golf grip during the overall swing. Thereby the user of the device according to the invention can play in time with the right golf grip without using the device. Experiments with an embodiment of the device according to the invention showed that using the gloves by golfers of various levels resulted in a substantial increase of level for each golfer.

BRIEF DESCRIPTION OF THE DRAWINGS

The invention will hereinafter be further explained by reference to the drawings, in which an embodiment of the device according to the invention is schematically shown.

DESCRIPTION OF THE PREFERRED EMBODIMENT

Figure 1A:
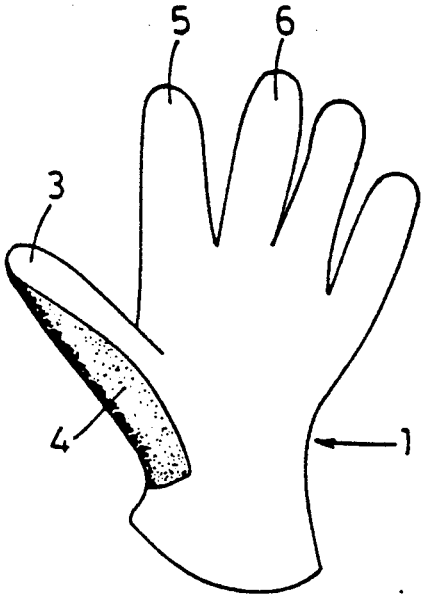
FIG. 1A and 1B is a view of the palm side of the left- and right-hand gloves of an embodiment of the device according to the invention.
Figure 1B:
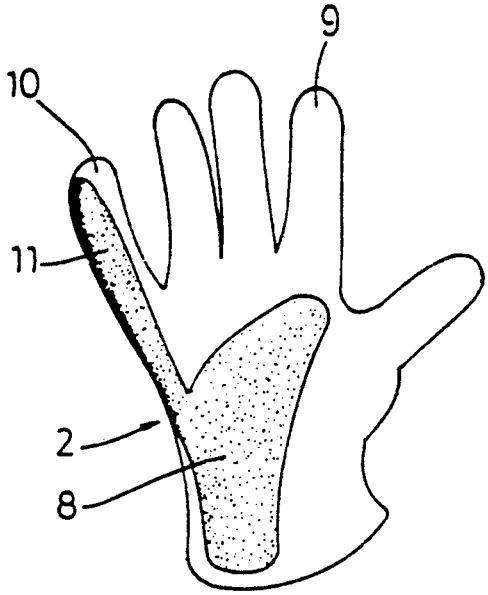
Figure 2A:
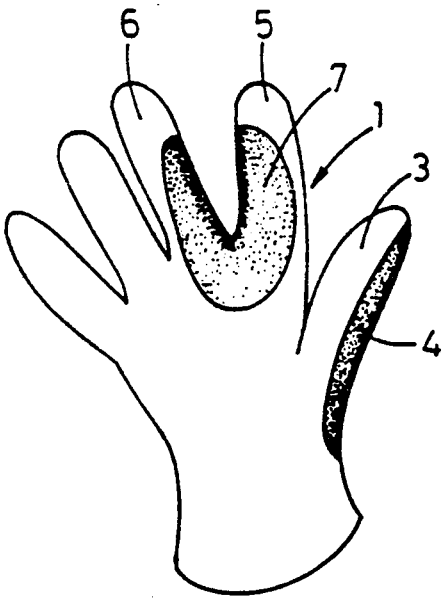
FIG. 2A and 2B is a view of the backside of the gloves of FIG. 1.
Figure 2B:
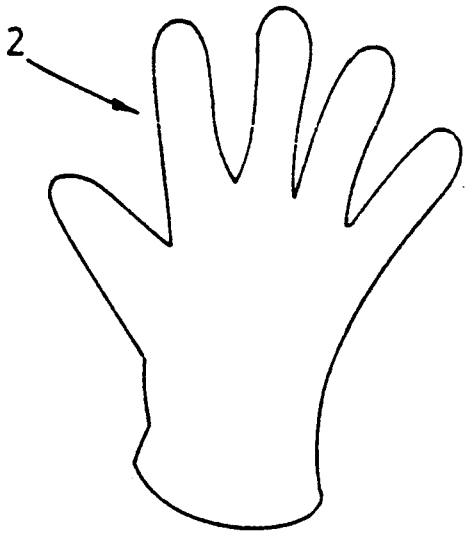

FIGs. 1A and 1B, and 2A and 2B show an embodiment of the device for improving and training a right golf grip during playing golf, which device comprises a left-hand glove 1 (FIG. 1A and 2A) and a right-hand glove 2 (FIG. 1B and 2B). The left-hand glove is provided at the backside of the thumb part 3 with a strip of loop or velours tape 4. Further the backside of the index and middle finger parts 5, 6 together with the intermediate area between the parts 5, 6 of the left-hand glove is also provided with loop tape 7.

The right-hand glove 2 (FIG. 1B and 2B) is provided with hook tape at certain positions of the palm side only, which hook tape can cooperate with the loop tape. In the first place, a strip of hook tape 8 extends with a large width substantially from just below the index finger part 9 diagonally to the insert side of the glove opposite of the little finger part 10. Further the little finger part 10 itself is also provided with a strip 11 of hook tape at the palm side.

Both gloves 1, 2 are made of a material operating as loop tape, for example so-called shark suede. Thereby it is obtained that even if during positioning in the right golf grip, the hook tape 8, 11 of the right-hand glove 2 does not fully contact the loop tape 4, 7 of the left-hand glove 1, nevertheless the hook tape 8, 11 adheres to the material of the glove 1 for one thing and for another during breaking the contact between the gloves 1, 2 a tearing sound occurs which is characteristic for separating loop and hook tape from each other. This indication of breaking the contact is of extreme importance as will be explained hereafter.

Figure 3:
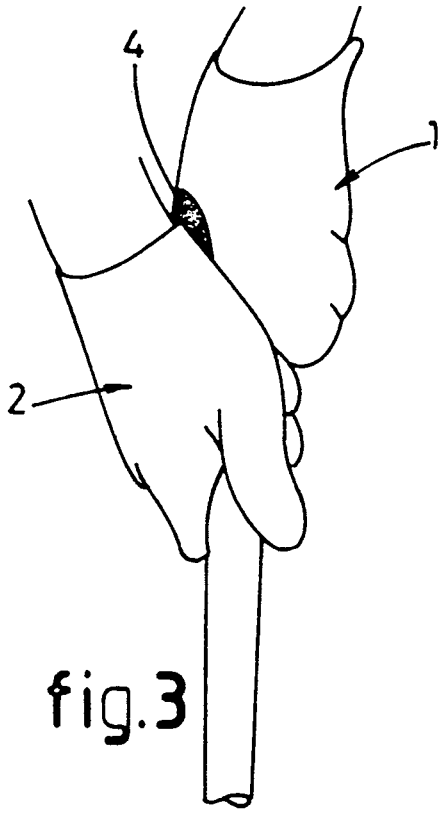
FIG. 3 schematically shows a top view of the position of the hands in the right golf grip using the device of FIGS. 1A and 1B and 2A and 2B.
Figure 4:
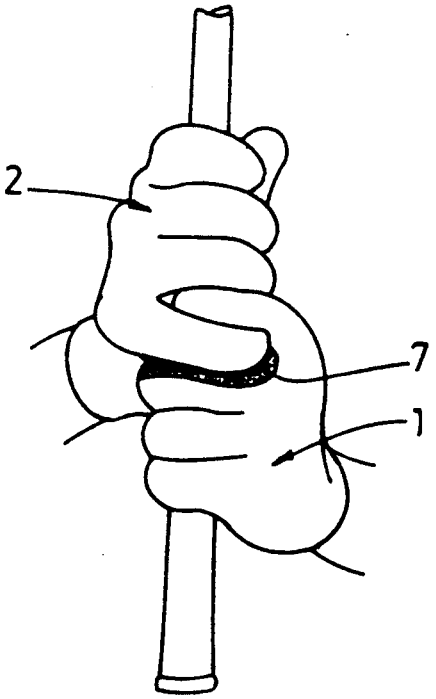
FIG. 4 schematically shows a bottom view of the position of the hands in the normal golf grip during use of the device according to FIGs. 1A and 1B, and 2A and 2B.

During training the right golf grip on the grip 11 of a golfclub in the manner schematically shown in FIGS. 3 and 4, the hook tape strip 8 at the palm side of the right-hand glove 2 will be placed on the strip of loop tape 4 on the thumb part 3 of the left-hand glove 1, whereas the hook tape strip 11 of the little finger part 10 of the right-hand glove 2 will be placed on the loop tape 7 of the index and middle finger parts 5, 6 of the left-hand glove 1. Thereby, the hands of the user are held one upon the other along the whole contact area in the right golf grip, whereby the user of the described device can improve and further train the right golf grip in a relatively simple manner. Experiments have shown that the level of golfers of various levels increases substantially by using the described device.

Moreover, any possible movement of the hands during the swing is indicated immediately by the breaking contact between the hook tape and loop tape or the material of glove 1. The indication of a change in the position of the hands is of extreme importance as by a wrong position of the hands the impact made will be less accurate. Even well trained golfers appear to change their grip during the swing unintendedly in practice. The device described results therefore not only in holding the hands in the right start position but further indicates each change during making the swing.

Figure 5:
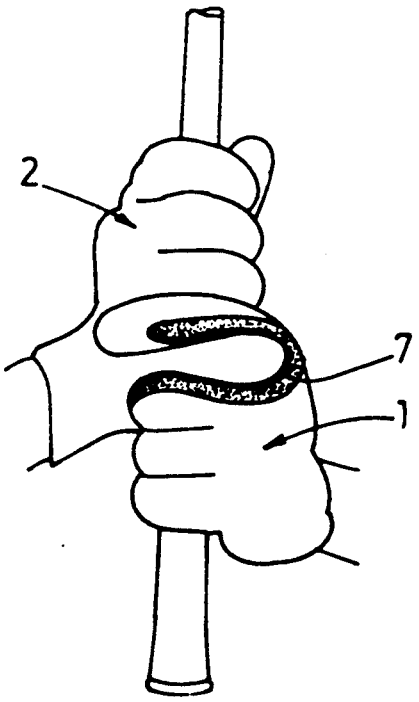
FIG. 5 shows a view corresponding with FIG. 4 when applying the so-called interlocking golf grip during use of the device of FIGS. 1A and 1B, and 2A and 2B.

At the device described the intermediate part between the index and middle finger parts 5, 6 is also provided with loop tape 7 so that the device is also suitable for improving the so-called interlocking golf grip which is shown in FIG. 5.

At the embodiment described the left-hand glove 1 is provided with loop or velours tape, while the right-hand glove 2 is provided with hook tape. However, it is also possible to provide hook tape on the left-hand glove and loop tape on the right-hand glove. Further it is noted that it is also possible to use other types of fastener means instead of hook and loop tape. It is noted that in case of a left-hand golfer the lefthand and right-hand gloves are provided mirrorwise with hook and loop tape.

The invention is not restricted to the abovedescribed embodiment which can be varied within a number of ways within the scope of the following claim.

I claim:

1. Device for improving and training a right golf grip, comprising a pair of gloves, wherein at least the back side of the thumb part and the back side of the index and middle finger parts together with their intermediate part of one glove, and at least a portion of the palm side of the little finger part and at least an area of the palm part of the other glove are provided with fastener means, which fastener means cooperate with each other for interlocking the gloves in the right golf grip, wherein a major portion of said palm side of said little finger part of said other glove is provided with fastener means and in that said area with fastener means of the palm part of this other glove extends with a large width substantially diagonally along said palm part from the insert side of the glove opposite of the little finger part, wherein at least said one glove is of a material operative to interconnect with the fastener means of the other glove so that the hands of the user are held one upon the other along the whole contact area, and produce a tearing sound when separated.

* * * * *